US005121876A

United States Patent [19]

Johnson

[11] Patent Number: 5,121,876

[45] Date of Patent: Jun. 16, 1992

[54] COLLAPSIBLE PAPERBOARD CARTON WITH LIQUID-TIGHT CORNERS

[75] Inventor: Fred J. Johnson, Long Beach, Calif.

[73] Assignee: Container Corporation of America, Clayton, Mo.

[21] Appl. No.: 775,508

[22] Filed: Oct. 15, 1991

[51] Int. Cl.[5] ..... B65D 5/36

[52] U.S. Cl. ..... 229/117.07; 229/149; 229/150; 229/169

[58] Field of Search ..... 229/117.04, 117.07, 229/117.08, 145, 149, 150, 152, 169

[56] References Cited

U.S. PATENT DOCUMENTS

| | | | |
|---|---|---|---|
| 644,857 | 3/1900 | Gair | 229/117.07 |
| 2,122,885 | 7/1938 | Lowey | 229/117.08 |
| 2,544,565 | 3/1951 | Phillips | 229/145 |
| 2,734,677 | 2/1956 | Arneson | 229/117.07 |
| 2,990,098 | 6/1961 | Kramer | 229/117.07 |
| 3,317,114 | 5/1967 | Ragan et al. | 229/152 |

FOREIGN PATENT DOCUMENTS

| | | | |
|---|---|---|---|
| 322648 | 2/1903 | France | 229/117.07 |
| 420969 | 2/1911 | France | 229/117.07 |
| 1217574 | 12/1970 | United Kingdom | 229/117.07 |

*Primary Examiner*—Gary E. Elkins
*Attorney, Agent, or Firm*—Richard W. Carpenter

[57] ABSTRACT

A collapsible, self-erecting, tray-type, one-piece carton having liquid-tight lower corners. The end walls of the carton each have a length greater than the width of the bottom wall and each have a pair of side edges that project a slight distance beyond the side walls, so that no opening exists at any lower corner of the carton where related side walls and end walls are joined to each other and to the bottom wall panel.

6 Claims, 3 Drawing Sheets

COLLAPSIBLE PAPERBOARD CARTON WITH LIQUID-TIGHT CORNERS

BACKGROUND OF THE INVENTION

1. Field of the Invention

This invention relates to collapsible, self-erecting, tray-type, paperboard cartons, and more particularly to a carton of the type that has liquid-tight lower corners.

2. Description of Background Art

A background art search directed to the subject matter of this application conducted in the United States Patent and Trademark Office disclosed the following U.S. Pat. Nos.:

| | | | |
|---|---|---|---|
| Re. 23,266 | 1,032,645 | 2,160,643 | 2,545,802 |
| 2,734,677 | 2,749,015 | 2,865,549 | 2,982,465 |
| 2,990,098 | 3,734,391 | 3,905,544 | 4,515,270 |

None of the patents found in the search discloses a collapsible, self-erecting, tray-type paperboard carton having liquid-tight lower corners formed by having carton end walls that extend a slight distance beyond the front and rear side walls so as to eliminate pin holes at the lower corners of the carton where the side and end wall are joined to each other and to the bottom wall when the carton is formed and erected.

SUMMARY OF THE INVENTION

It is a primary object of the invention to provide a collapsible, self-erecting, tray-type, paperboard carton with liquid-tight lower corners.

A more specific object of the invention is the provision of a carton of the type described wherein the end walls of the carton extend a slight distance beyond the front and rear side walls, so there will be no pin holes at the lower corners of the carton where the side walls are joined to the end walls and to the bottom wall.

These and other objects of the invention will be apparent from an examination of the following description and drawings.

It will be understood that, for purposes of clarity, certain elements may have been intentionally omitted from certain views where that are believed to be illustrated to better advantage in other views.

BRIEF DESCRIPTION OF THE PREFERRED EMBODIMENT

The original collapsible, self-erecting, tray-type, paperboard carton was developed at least as long ago as 1912, when A. W. Beers obtained U.S. Pat. No.

1,032,645. This style of carton has been produced and used in the packaging industry for almost 80 years. It is still in use, and it is still commonly referred to as a "Beers" carton.

Figure 6:
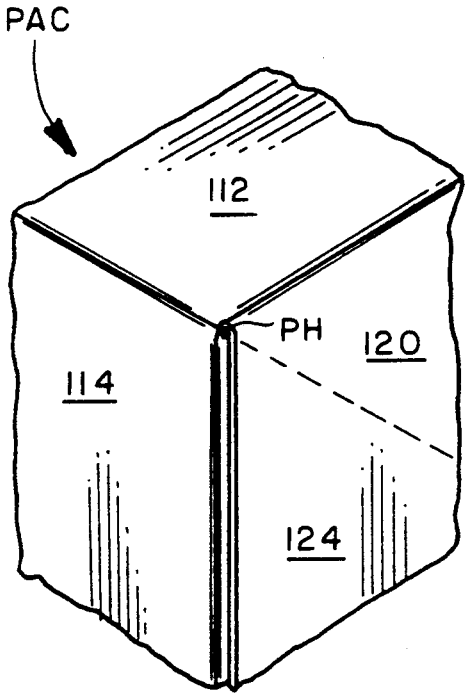
FIG. 6 (PRIOR ART)
FIGS. 6, 7, and 8 are views similar to those of FIGS. 2, 3, and 5, respectively, but illustrate a conventional carton.
Figure 7:
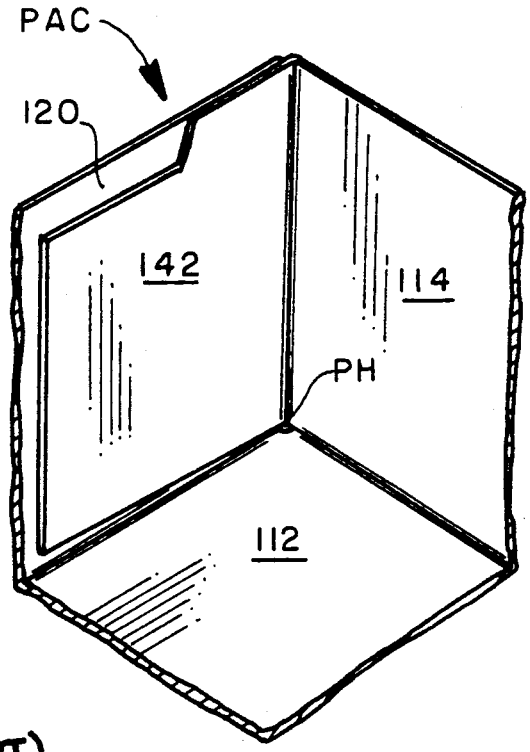
FIG. 7 (PRIOR ART)
Figure 8:
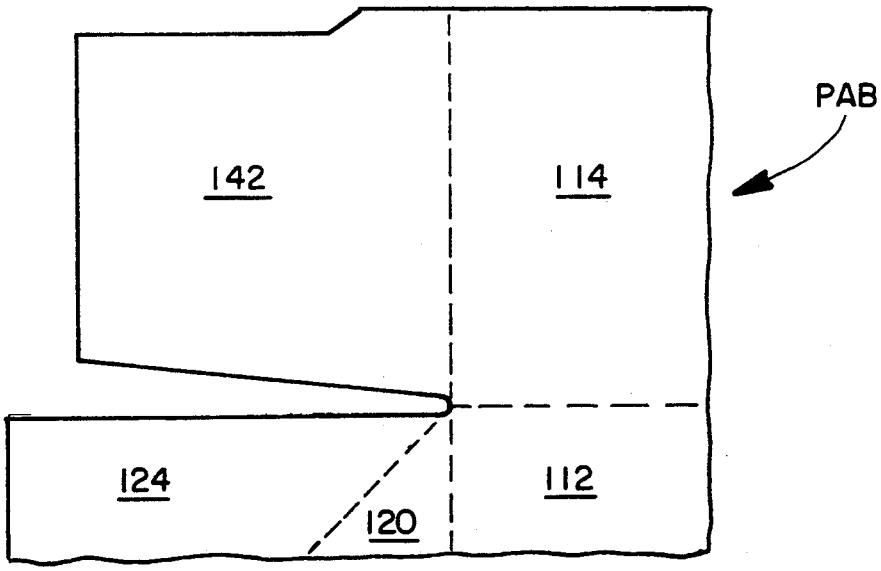
FIG. 8 (PRIOR ART)

While the conventional Beers carton still has many uses, one prime example being bakery goods, the major disadvantage of the Beers construction is that the slots formed in the carton blank between the end wall panels and the adjacent corner flaps result in the creation of pin holes at the lower corners of the carton, as indicated at PH in FIGS. 6 and 7, when the corner flaps are folded 90 degrees and adhesively secured to the related end wall panel side sections.

Since the Beers carton construction does not provide a carton with liquid-tight corners, its use is limited to the packaging of dry products.

It is believed that the present invention provides a significant contribution to the packaging industry, because it provides a collapsible, self-erecting, tray type carton with liquid-tight corners that is well suited to carry-out food products with sauces, such as dressings, gravies, and syrups.

Figure 1:
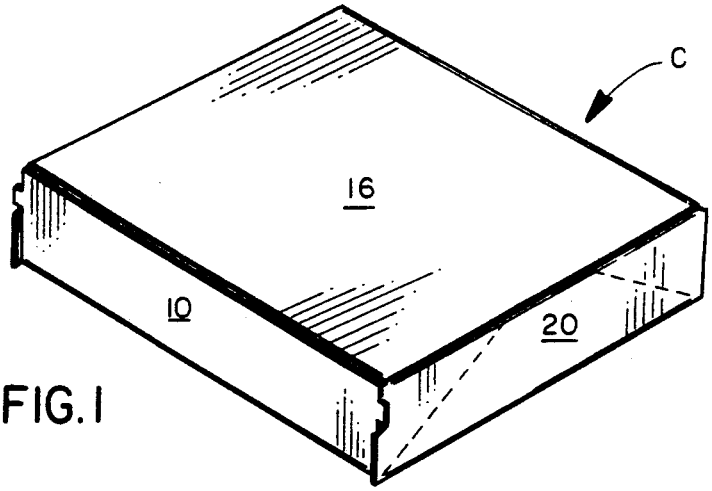
FIG. 1 is a fragmentary isometric view of a carton embodying features of the present invention.
Figure 5:
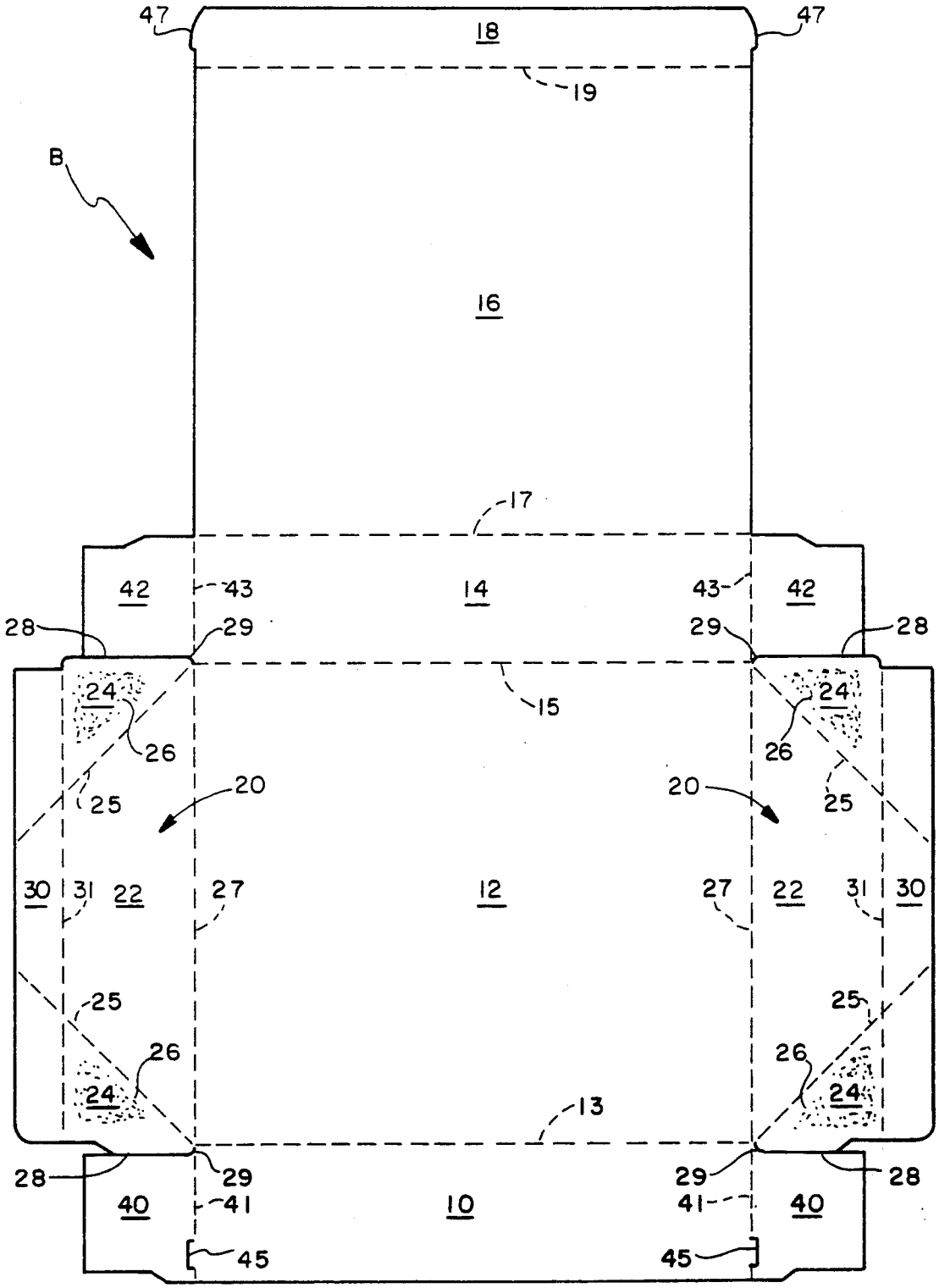
FIG. 5 is a plan view of a blank of paperboard from which the carton illustrated in the previously described views may be formed.

Referring now to the drawings for a better understanding of the invention, it will be seen that the carton indicated at C in FIG. 1 of the drawings may be formed from the unitary blank B of foldable sheet material illustrated in FIG. 5.

As best seen in FIGS. 1 and 5, carton C is a tray-type carton that includes a bottom wall panel 12, having a pair of opposed front and rear side wall panels 10 and 14 foldably joined to and upstanding from front and rear side edges thereof along fold lines 13 and 15, respectively, and having a pair of opposed end wall panels 20 foldably joined to and upstanding from end edges thereof along fold lines 27.

Each of the side wall panels 20 includes a trapezoidal shaped center section 22 flanked by a pair of triangular side sections 24 joined to the center section along downwardly diverging fold lines 25.

In order to reinforce the carton body there may be provided a pair of relatively narrow flanges or dust flaps 30 foldably joined to upper edges of side wall panels 20 along fold lines 31 and adapted to be folded inwardly 90 degrees when the carton is erected and closed.

The carton side and end wall panels are joined to each other at the corners of the carton by front and rear pairs of corner flaps 40 and 42, which are foldably joined to opposed end edges of front and rear side walls 10 and 14 along fold lines 41 and 43, respectively.

Each corner flap has one portion adhesively secured, by an adhesive indicated at 26, to an inner surface of an adjacent end wall panel side section 24 and has another portion disposed to lie against, but free from attachment to, an inner surface of related end wall panel center section 22, when the carton is erected.

Figure 4:
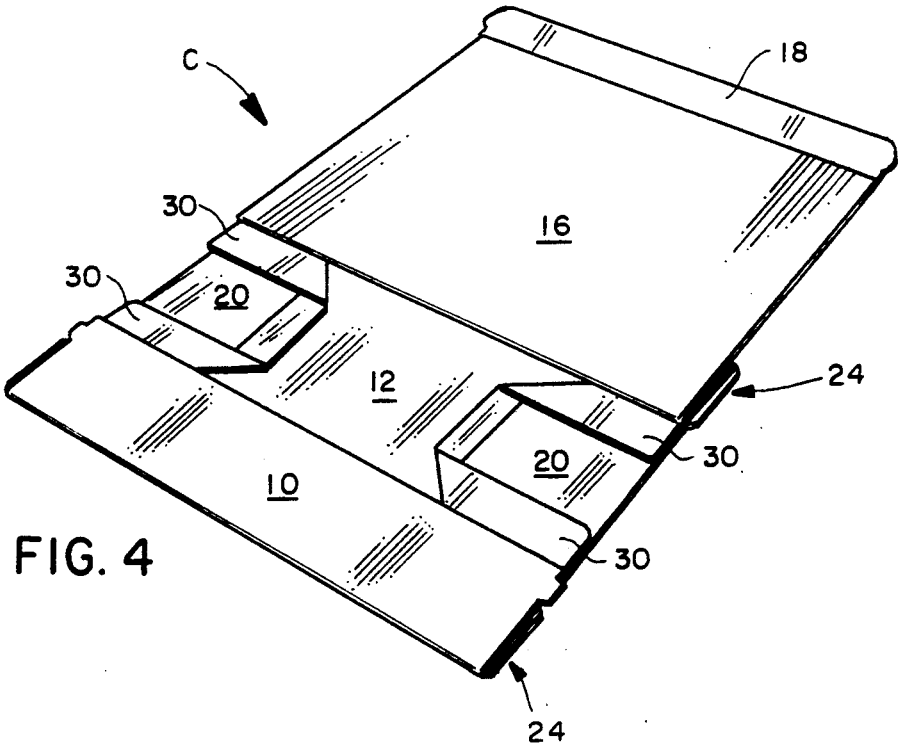
FIG. 4 is a view similar to that of FIG. 1, but showing the carton in a collapsed condition.

The carton may have a separate cover (not shown) or may be provided with a hinged cover, as shown in FIG. 4. The hinged cover may comprise a top wall panel 16 foldably joined at its rear edge along fold line 17 to the upper edge of rear side wall panel 14.

A tuck flap 18 is foldably joined along fold line 19 to the front edge of top wall panel 16. The tuck flap may be provided with lock tabs 47 which project outwardly from opposite ends thereof and which are adapted to be received within openings 45 formed in the front corner flaps 40 when the cover is in a closed position.

Figure 2:
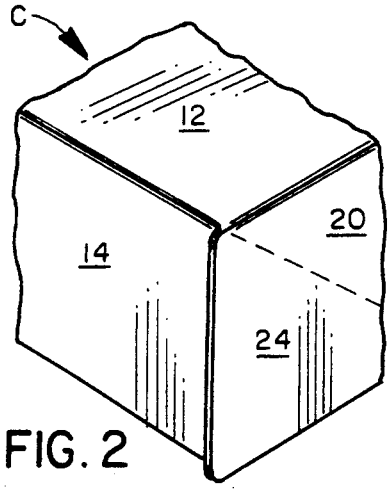
FIG. 2 is an enlarged view of a corner portion of the structure illustrated in FIG. 1.
Figure 3:
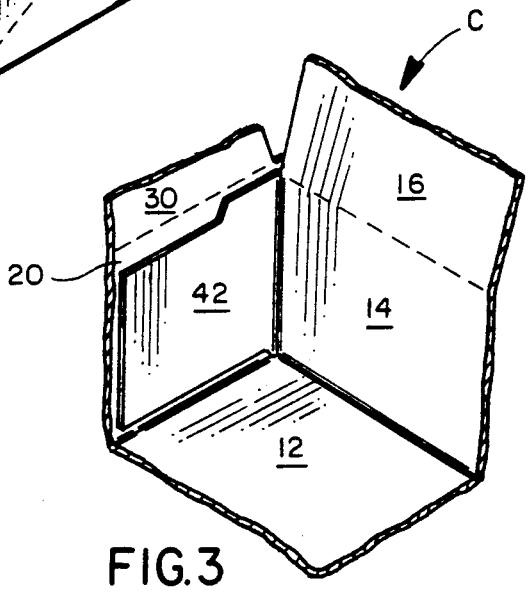
FIG. 3 is a view similar to that of FIG. 2, but showing the inside of the carton corner portion.

The essential feature of the invention is the unique corner construction which provides liquid-tight corners. This is best illistrated in FIGS. 2, 3, and 5, where it can be seen that the end wall panels are each longer that the width of the bottom wall panel, so that the end wall side sections extend a slight distance beyond the front and rear side walls.

The end wall panel side sections each have an end edge that includes a straight vertically extending major portion 28 and an arcuate minor portion 29, extending from the lower end of the major portion 28 to the adjacent end of the fold line 21 that joins the end wall panel 20 to the bottom wall panel 12.

This overlap construction assures that the lower corners of the carton will be free from the pin holes commonly found in the corners of conventional cartons, so that the corners will be liquid-tight. Thus, the unique carton construction fills a need in the packaging art, for a collapsible carton with liquid-tight corners, that has existed for almost eighty years.

What is claimed is:

1. A collapsible, self-erecting, tray-type carton having liquid-tight lower corners, said carton being formed from a unitary blank of foldable paperboard and comprising:

(a) a generally rectangular bottom wall panel;

(b) opposed front and rear side wall panels foldably joined to and upstanding from front and rear side edges, respectively, of said bottom wall panel;

(c) opposed end wall panels foldably joined to and upstanding from opposed end edges of said bottom wall panel, each end wall panel including a trapezoidal shaped center section flanked by a pair of triangular shaped side sections joined to said center section along downwardly diverging fold lines;

(d) opposed front and rear corner flaps foldably joined to opposed end edges of said front and rear side wall panels, respectively;

(e) each of said corner flaps having one portion adhesively secured to an inside surface of an adjacent one of said end wall panel side sections and having another portion disposed to lie against; but free from attachment to, an inner surface of an adjacent end wall panel center section;

(f) said end wall panels each having a length greater than the width of said bottom wall panel, whereby each end wall panel side section has a free, vertical side edge that projects a slight distance beyond a fold line joining said bottom wall panel to an adjacent one of said side walls, so that no opening exists at any lower corner of the carton where side wall and end wall panels are joined to each other and to said bottom wall panel;

(g) each of said end wall panel side section free side edges having a straight, vertically extending, major portion, that is offset outboardly from but lies generally parallel to the fold line joining said bottom wall panel to an adjacent one of said side wall panels, and has a curved minor portion that extends between a lower end of said major portion and an adjacent end of the fold line joining said bottom wall panel to said end wall panel.

2. A carton according to claim 1, and including a cover comprising:

(a) a top wall panel foldably joined to an upper edge of said rear side wall panel;

(b) a tuck flap foldably joined to a front edge of said top wall panel and arranged and disposed to be inserted behind said front wall side panel when the carton is erected and closed.

3. A carton according to claim 1, and including a pair of reinforcing flaps foldably joined to upper edges of respective end wall panels and disposed to be folded inwardly so as to lie under said cover top wall panel.

4. A unitary blank of foldable paperboard for use in forming a collapsible, self-erecting, tray-type carton having liquid-tight lower corners, said blank being cut and scored to provide:

(a) a generally rectangular bottom wall panel;

(b) front and rear side wall panels foldably joined along first fold lines to front and rear side edges, respectively, of said bottom wall panel;

(c) end wall panels foldably joined along second fold lines to opposed opposed end edges of said bottom wall panel;

(d) each end wall panel including a trapezoidal shaped center section flanked by a pair of triangular shaped side sections joined to said center section along inboardly diverging third fold lines;

(e) front and rear corner flaps foldably joined along fourth fold lines to opposed end edges of said front and rear side wall panels, respectively;

(f) said end wall panels each having a length greater than the width of said bottom wall panel, whereby each end wall panel side section has a free side edge that projects a slight distance beyond an adjacent one of said first fold lines, so that no opening will exist at any lower corner of the carton where side wall and end wall panels are joined to each other and to said bottom wall panel when the carton is erected;

(g) each of said end wall panel side section free side edges having a straight, vertically extending, major portion, that is offset outboardly from but lies generally parallel to the fold line joining said bottom wall panel to an adjacent one of said side wall panels, and has a curved minor portion that extends between a lower end of said major portion and an adjacent end of the fold line joining said bottom wall panel to said end wall panel.

5. A blank according to claim 4, and including a cover portion comprising:

(a) a top wall panel foldably joined to an edge of said rear side wall panel;

(b) a tuck flap foldably joined to an outboard edge of said top wall panel.

6. A blank according to claim 4, and including reinforcing flaps foldably joined to outboard edges of respective end wall panels.

* * * * *